US012247412B2

(12) United States Patent
McFarland

(10) Patent No.: US 12,247,412 B2
(45) Date of Patent: Mar. 11, 2025

(54) WAVE MAKING WATER FOIL

(71) Applicant: American Wave Machines, Inc., Solana Beach, CA (US)

(72) Inventor: Bruce McFarland, Solana Beach, CA (US)

(73) Assignee: American Wave Machines, Inc., Solana Beach, CA (US)

( * ) Notice: Subject to any disclaimer, the term of this patent is extended or adjusted under 35 U.S.C. 154(b) by 0 days.

(21) Appl. No.: 18/132,245

(22) Filed: Apr. 7, 2023

(65) Prior Publication Data

US 2024/0183178 A1 Jun. 6, 2024

Related U.S. Application Data

(60) Provisional application No. 63/457,048, filed on Apr. 4, 2023, provisional application No. 63/430,318, filed on Dec. 5, 2022.

(51) Int. Cl.
*E04H 4/00* (2006.01)

(52) U.S. Cl.
CPC ..... *E04H 4/0006* (2013.01)

(58) Field of Classification Search
CPC ..... A63B 69/0093; E04H 4/0006
USPC ..... 4/491; 405/79
See application file for complete search history.

(56) References Cited

U.S. PATENT DOCUMENTS 4,792,260 A * 12/1988 Sauerbier ..... E04H 4/0006 4/491
6,047,657 A * 4/2000 Cox ..... B63B 21/56 114/343
2013/0199433 A1* 8/2013 Lochtefeld ..... B66D 1/20 405/79
2015/0089731 A1* 4/2015 Lochtefeld ..... E04H 4/0006 4/491
2017/0044784 A1* 2/2017 Slater ..... A63G 31/007
2019/0063092 A1* 2/2019 Fincham ..... A63B 69/0093
2023/0116225 A1* 4/2023 Geiger ..... E04H 4/0006 4/491

FOREIGN PATENT DOCUMENTS

WO WO-2013071362 A1 * 5/2013 ..... A63D 5/10
WO WO-2019100107 A1 * 5/2019
WO WO-2019193505 A1 * 10/2019

OTHER PUBLICATIONS

International Search Report Dated Jan. 8, 2024 for PCT/US23/036095 (9 pgs).

* cited by examiner

*Primary Examiner* — Erin Deery
*Assistant Examiner* — William R Klotz
(74) *Attorney, Agent, or Firm* — Manuel de la Cerra

(57) ABSTRACT

A wave generating foil for use in a wave pool is disclosed. The foil has an inner surface that extends from a leading edge to a trailing edge, and the inner surface also extends below and above the water line of the wave pool. The inner surface faces the shore of the wave pool and is constructed to be propelled along a travel line that defines a shore side and an opposite side. The inner surface has (1) a first section that extends away from the leading edge and runs substantially parallel to the travel line; and (2) a second section that extends away from the first section towards the opposite side.

16 Claims, 11 Drawing Sheets

TOP VIEW

FRONT VIEW

TOP VIEW

FRONT VIEW

FRONT VIEW (Top View)

(Wave Pool Top View)

(Wave Pool Top View)

(Curved Foil Top View)

(Wave Pool Cross Section)

WAVE MAKING WATER FOIL

RELATED APPLICATIONS

This application is the non-provisional of U.S. Patent Application Ser. No. 63/430,318, filed on Dec. 5, 2022, and also the non-provisional of U.S. Patent Application No. 63/457,048, filed on Apr. 4, 2023; the entire contents of both of these applications are incorporated herein by reference.

TECHNICAL FIELD

The present invention relates generally to a wave forming apparatus and is partially concerned with water rides of the type provided in water-based amusement parks, particularly a wave forming apparatus and a method for forming surfable waves.

BACKGROUND

It is common to observe wakes created by bows and hulls of boats in water. This has led to inventions using this concept to create "waves" in pools for the purpose of surfing. Related, but different, is the use of a foil moved through the water to produce the positive (upward relative to the static surface) displacement resembling the peak of a wave. Foils are differentiated from hulls of boats because they extend from the surface downward, close to the bottom, in order to be more efficient in the water compared to a hull on a boat penetrating only part of the depth. Also, the foil extends far enough above the water line to support the raised height of the wake or wave peak created by the positive displacement of water upwards and towards a shore.

Another class of moving-object wake generation is a completely submerged hull, which displaces water upward and outward, also creating a wake.

Still another class is a surface-cutting deflector, which, as it moves through the water, lifts the water and then throws it forward to create a rideable hydraulic nearly on top of the apparatus and operates in only the upper part of the total depth.

The short-coming of the prior art is that only a part of the motion of a wave is created. This part is the upward-and-forward motion. A full wave, however, is comprised of downward-and-backward motion followed by upward-and-forward motion. A full wave surfs differently and more naturally than a partial wave of the prior art.

SUMMARY

The wave generating apparatus of the present invention presents an elegant and effective solution to creating large and ridable full waves. Specifically, a wave generating foil for use in a wave pool is disclosed. The foil has an inner surface that extends from a leading edge to a trailing edge, and the inner surface also extends below and above the water line of the wave pool. The inner surface faces the shore of the wave pool and is constructed to be propelled along a travel line that defines a shore side and an opposite side. The inner surface has (1) a first section that extends away from the leading edge and runs substantially parallel to the travel line; and (2) a second section that extends away from the first section towards the opposite side.

The inner surface may also include a third section that extends away from the second section towards the shore side. The inner surface may also have a fourth section that extends away from the third section and runs substantially parallel to the travel line.

The foil may have a plane of symmetry extending perpendicularly from the travel line and intersecting the inner surface at the junction of the second and third sections. The symmetrical foil may be propelled in either direction along the travel line, and may create waves in either direction.

A wave generating system is also disclosed that incorporates the foil. The system has a wave pool, a conveyance and a foil connected to a conveyance. The conveyance can travel in a straight path or a curved path. The wave pool shore may be straight or curved. The wave pool may have a sloped floor with several slopes.

Additional aspects, alternatives and variations as would be apparent to persons of skill in the art are also disclosed herein and are specifically contemplated as included as part of the invention. The invention is set forth only in the claims as allowed by the patent office in this or related applications, and the following summary descriptions of certain examples are not in any way to limit, to define or otherwise to establish the scope of legal protection.

BRIEF DESCRIPTION OF THE DRAWINGS

The invention can be better understood with reference to the following figures. The components within the figures are not necessarily to scale, emphasis instead being placed on clearly illustrating example aspects of the invention. In the figures, like reference numerals designate corresponding parts throughout the different views and/or embodiments. Furthermore, various features of different disclosed embodiments can be combined to form additional embodiments, which are part of this disclosure. It will be understood that certain components and details may not appear in the figures to assist in more clearly describing the invention.

DETAILED DESCRIPTION

Figure 1A:
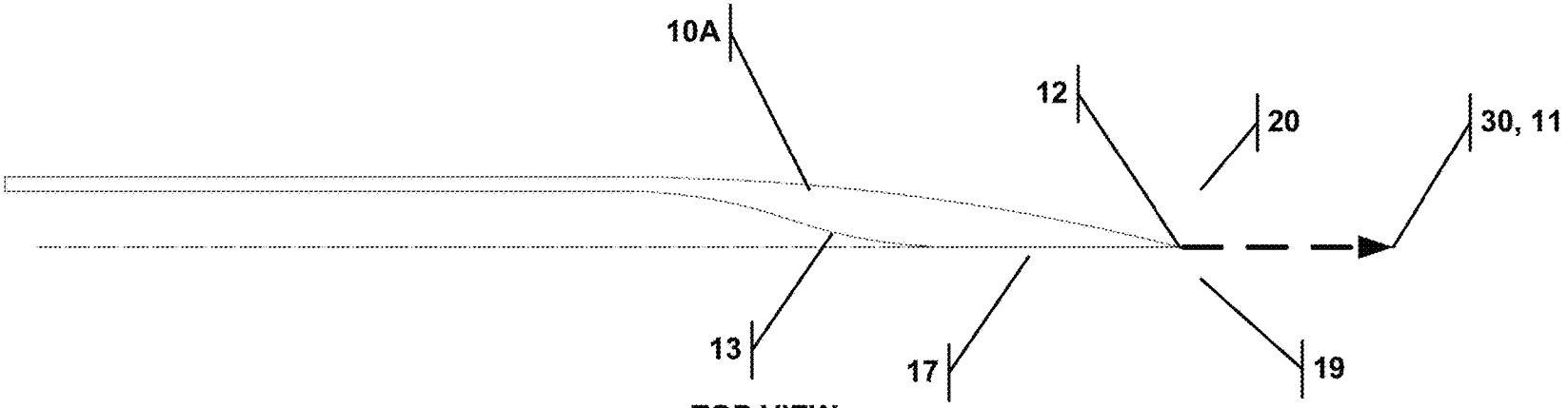
FIG. 1A is a top view of a wave-making water foil.

Reference is made herein to some specific examples of the present invention, including any best modes contemplated by the inventor for carrying out the invention. Examples of these specific embodiments are illustrated in the accompanying figures. While the invention is described in conjunction with these specific embodiments, it will be understood that it is not intended to limit the invention to the described or illustrated embodiments. To the contrary, it is intended to cover alternatives, modifications, and equivalents as may be included within the spirit and scope of the invention as defined by the appended claims.

In the following description, numerous specific details are set forth to provide a thorough understanding of the present invention. Example embodiments of the present invention may be implemented without some or all of these specific details. In other instances, process operations well known to persons of skill in the art have not been described in detail in order not to obscure unnecessarily the present invention. Various techniques and mechanisms of the present invention will sometimes be described in singular form for clarity. However, it should be noted that some embodiments include multiple iterations of a technique or multiple mechanisms unless noted otherwise. Similarly, various steps of the methods shown and described herein are not necessarily performed in the order indicated, or performed at all, in certain embodiments. Accordingly, some implementations of the methods discussed herein may include more or fewer steps than those shown or described. Further, the techniques and mechanisms of the present invention will sometimes describe a connection, relationship or communication between two or more entities. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection, unless otherwise noted.

The following list of example features corresponds with the attached figures and is provided for ease of reference, where like reference numerals designate corresponding features throughout the specification and figures:

10A, 10B, 10C, 10D Foil
11 Line of Travel
11A Perpendicular To Line of Travel
12 Leading Edge
12A First Section (Parallel to Line of Travel Foil Section, Straight Foil)
12A2 First Section (Parallel to Line of Travel Foil Section, Curved Foil)
13 Second Section (Initial Run Away from Shore Section)
14 Third Section (Return Section)
14A Fourth Section (Parallel to Line of Travel Foil Section, Straight Foil)
14A2 Fourth Section (Parallel to Line of Travel Foil Section, Curved Foil)
15 Plane of Symmetry
16 Trailing Edge
17 Foil Inner Surface
18 Foil Opposite Side
19 Shore Side
20 Opposite Side
25 Static Water Line
30 Travel Direction of Foil
35 Peak of Breaking Wave
40 Trough of Breaking Wave
45 Rightward Travel Direction of Foil
50 Peak of Breaking Wave (Rightward Travel)
55 Trough of Breaking Wave (Rightward Travel)
60 Leftward Travel Direction of Foil
65 Peak of Breaking Wave (Leftward Travel)
70 Trough of Breaking Wave (Leftward Travel)
75 Wave Pool
76 Wave Pool (Curved)
77 Wave Pool Floor
80 Wave Propagation Direction
85 Conveyance
86A Conveyance Straight Path
86B Conveyance Curved Path
90 Shore
95 Wave Amplification The present water foil improves upon the prior art by creating a full wave comprised of downward-and-backward motion followed by upward-and-forward motion. The inner foil surface turns away from the shore to displace water, rather than towards the shore to displace water, creating a negative displacement, or trough, behind the leading edge of the foil. This trough is lower than the static water level and, under force of gravity, causes water to first move downward and away from the shore and then move up the face of the wave and the foil before moving towards the shore. Looking from the top perspective, if a line represents the direction of travel of the foil, the inner foil is shaped to initially optimize for low drag and small bow wake, but then it arcs or angles in a direction away from the line of travel and away from the shore and shallower water. This foil shape is the opposite of the prior art.

Figure 1B:
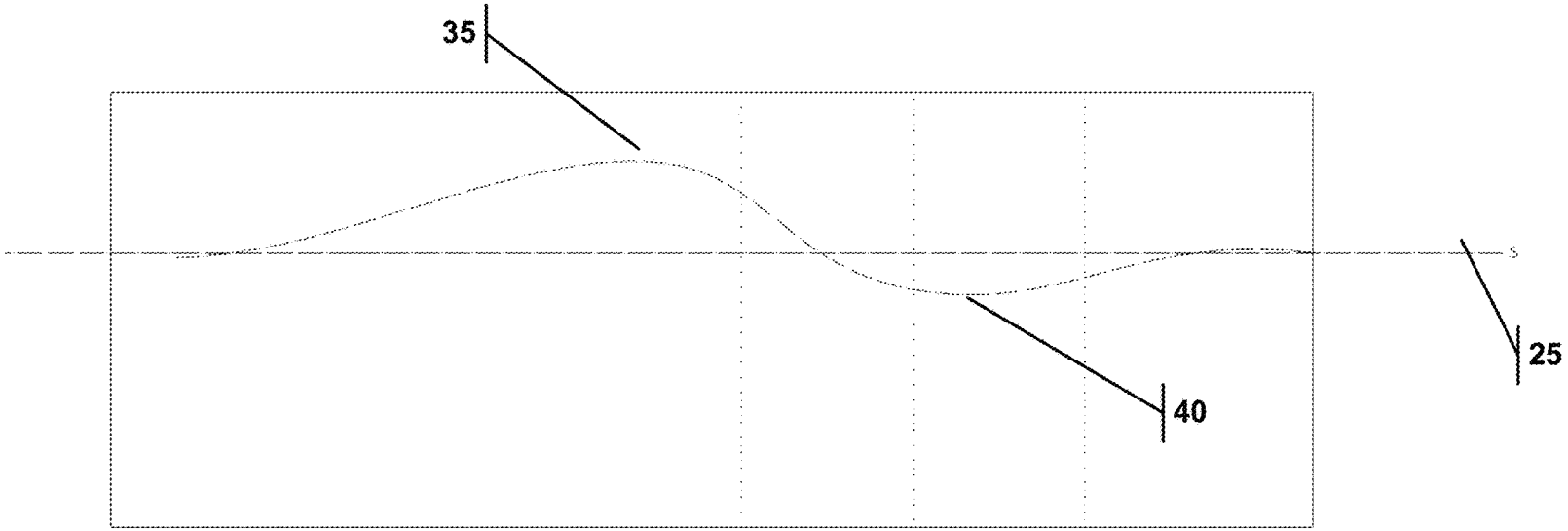
FIG. 1B is a front view from the shore of the wave profile made by the water foil of FIG. 1A.

Referencing FIGS. 1A and 1B, a foil 10A is presented that can create a wave only when traveling through the water in one direction 30. The foil 10A comprises an inner surface 17 (i.e. the surface that faces the shore side 19) shaped simply as a straight reflecting surface. The complete wave would then peak up, and gravity would force it towards the shore. This pull-push motion mimics the circular particle motion of natural ocean waves. In the top view (FIG. 1A), the foil's leading edge 12 is designed for low drag and creates the space for the water to move away from shore, forming a trough 40. The foil 10A accomplishes this with an inner surface shape with a first section 12A extending away from the leading edge 12 and substantially parallel to the travel line 11, followed by a second section 13B that extending away from the first section 12A towards the opposite side 20—i.e., away from the shore side 19. Water is pulled away from the shore side 19, creating the trough 40. In the front view (FIG. 1B), the static water line 25 is shown, as well as the profile of the wave with the trough 40 leading the peak 35.

Figure 2A:
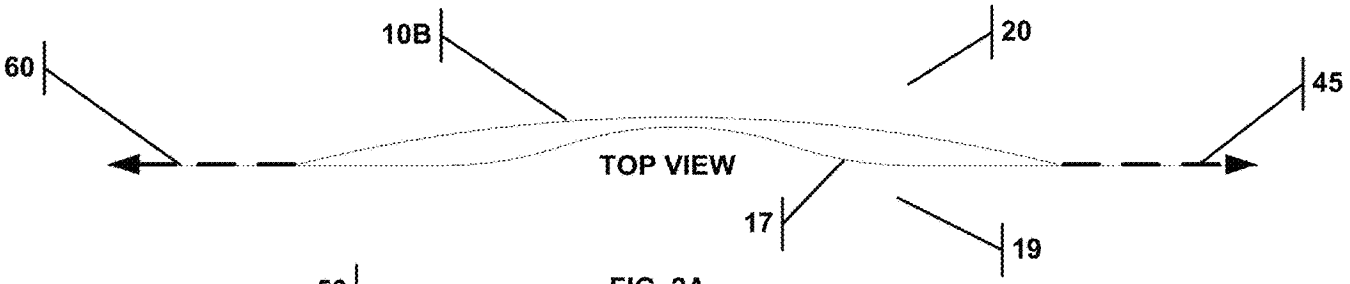
FIG. 2A is a top view of a wave-making water foil.
Figure 2B:
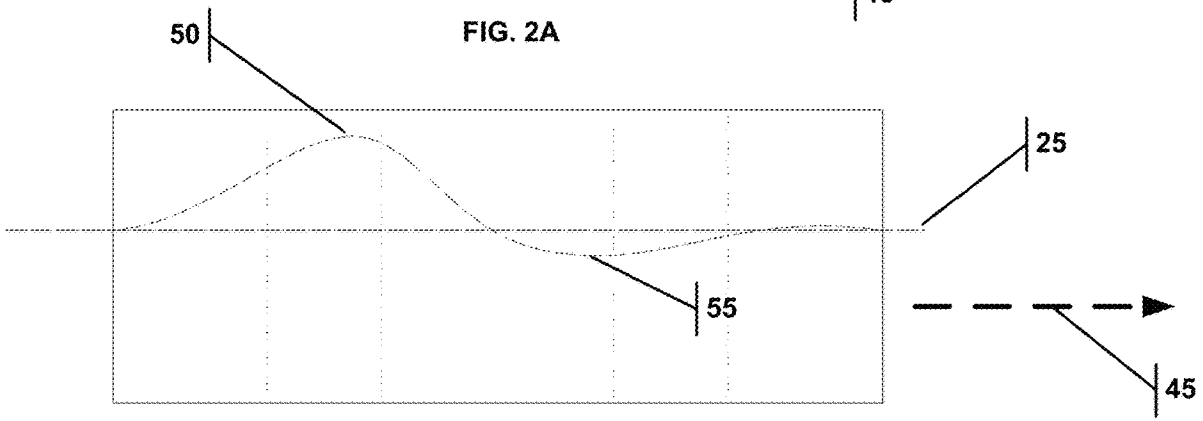
FIG. 2B is a front view from the shore of the wave profile made by the water foil of FIG. 2A when the foil travels to the right.
Figure 2C:
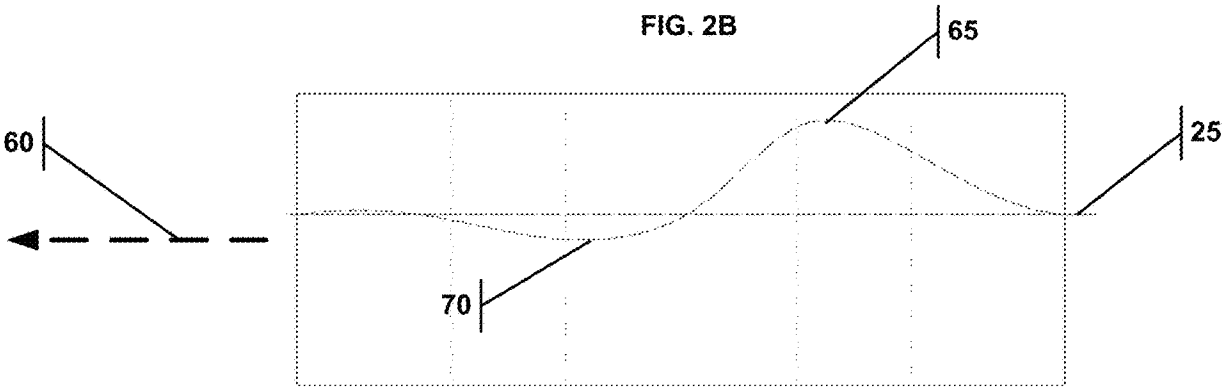
FIG. 2C is a front view from the shore of the wave profile made by the water foil of FIG. 2A when the foil travels to the left.
Figure 2D:
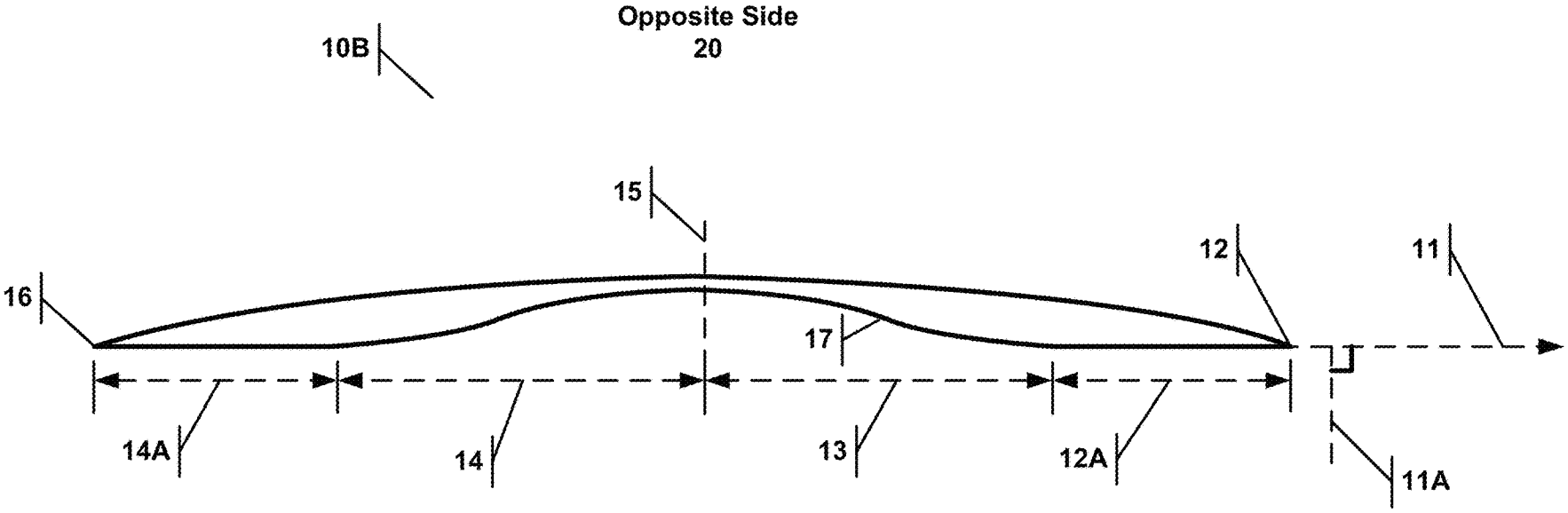
FIG. 2D is an enlarged top view of the water foil of FIG. 2A, illustrating the details of the foil.

Referencing FIGS. 2A-2D, the preferred embodiment of the foil 10B is shown. The foil 10B is symmetric about a plane of symmetry 15 for travel in both directions. Regardless of the travel direction, the inner surface foil shape does not initially push water towards shore. A first section 12A of the inner surface 17 may be substantially parallel to the line of travel 11 to provide a smooth entry and minimum bow wake. A second section 13 extends away from the first section 12A towards the opposite side 20. As the foil 10B travels in the direction 45, it pulls water away from the shore side 19, forming a trough 55. Unlike foil embodiment 10A, when the foil 10B reaches a maximum negative shape position (i.e., maximum distance away from the shore side 19 in the perpendicular direction to the line of travel 11A), the inner surface 17 transitions back towards the parallel line of travel 11. This third section 14 represents both a reflecting zone for inward-moving water and a push zone for water. Reflection, in combination with push, amplifies the height of the total wave. FIG. 2B is a front view of the wave profile, illustrating the peak 50 and trough 55, when the foil 10B travels in the rightward direction 45. When the travel is reversed to the leftward direction 60, the peak 65 and trough 70 are shown in FIG. 2C. The inner surface 17 also has a fourth section 14A extending away from the third section 14 and substantially parallel to the travel line (11). The plane of symmetry 15 extends perpendicularly from the travel line 11 and intersects the inner surface at the junction of the second 13 and third 14 sections.

Figure 3:
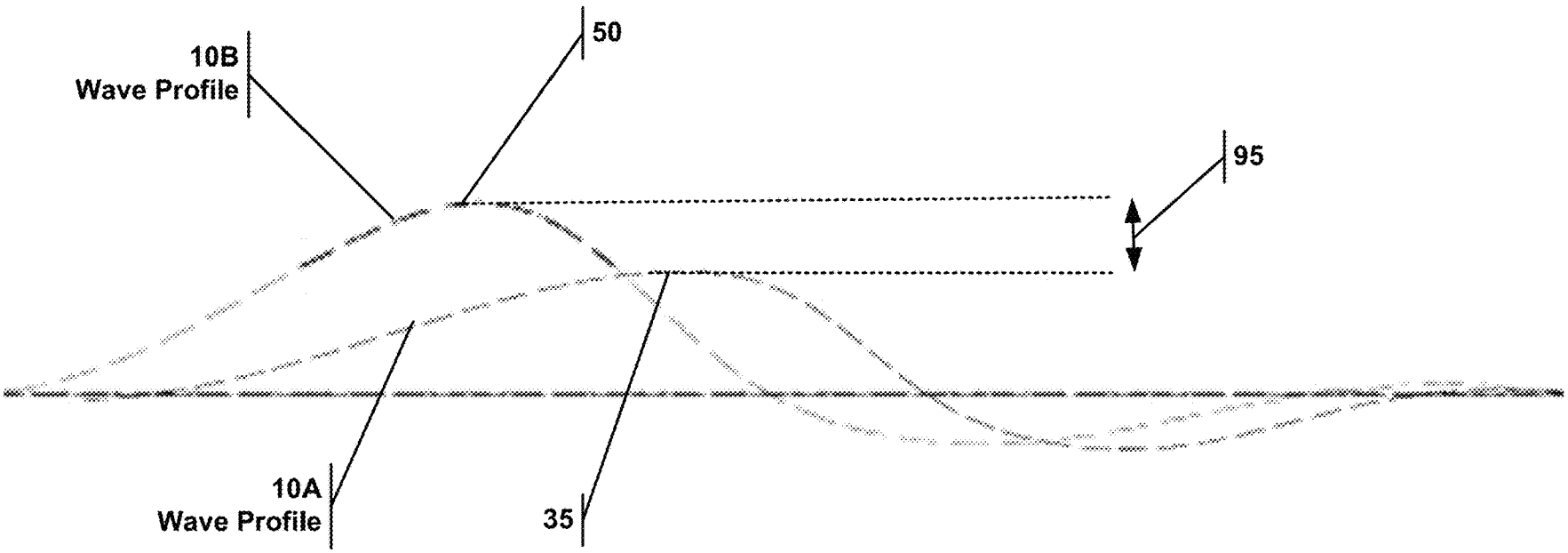
FIG. 3 is a superimposition of the wave profiles generated by the embodiments described herein.

FIG. 3 superimposes the wave profile from foil 10A onto that of foil 10B. The wave peak 50 generated by foil 10B is clearly higher than that of foil 10A (see peak 35). The third section 14 of foil 10B reflects inward moving water and a pushes water to create an amplification 95 or an increase in the height of the wave's peak.

Figure 4A:
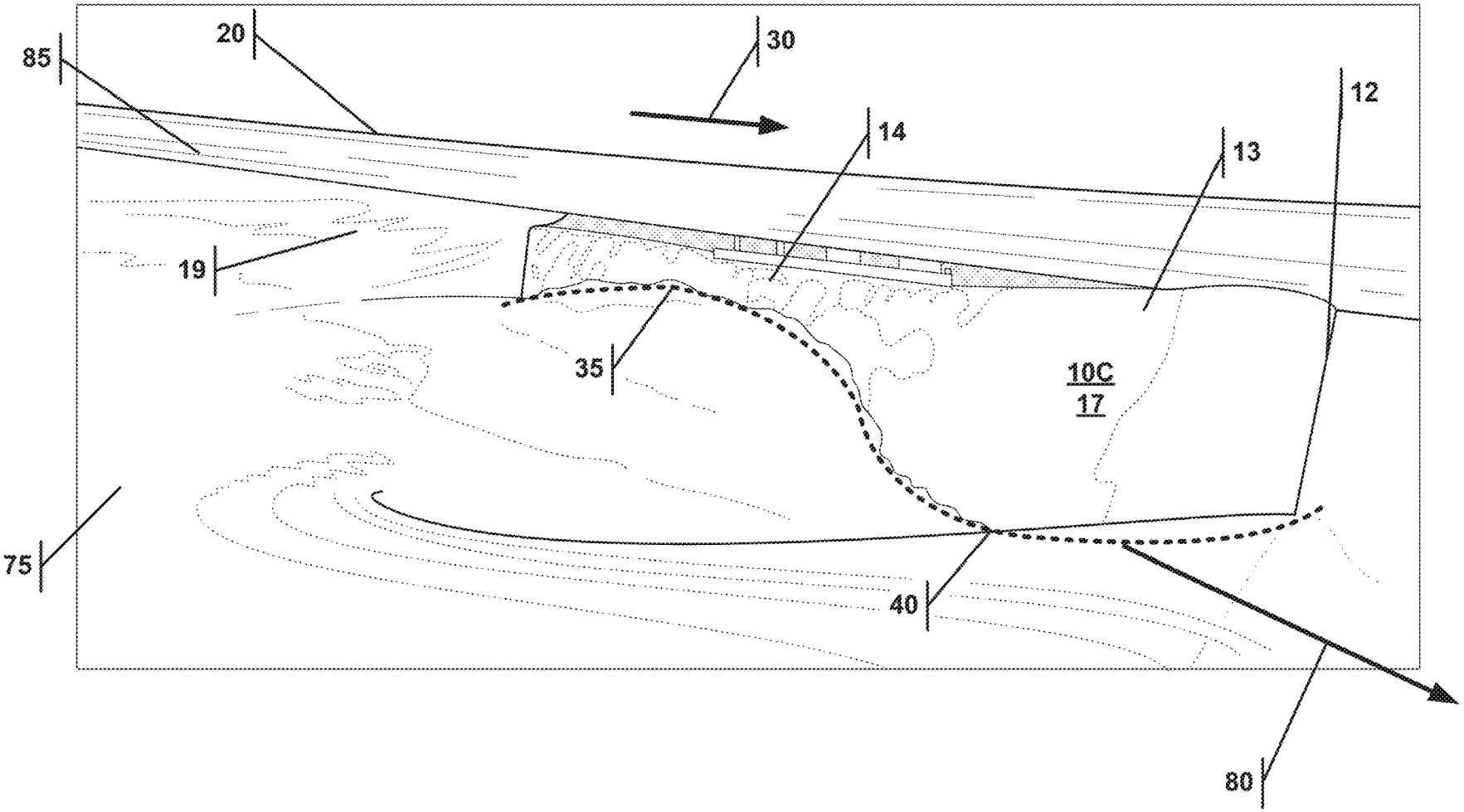
FIG. 4A is a first photo-illustrated view of a water foil being pulled through a wave pool by a conveyance.
Figure 4B:
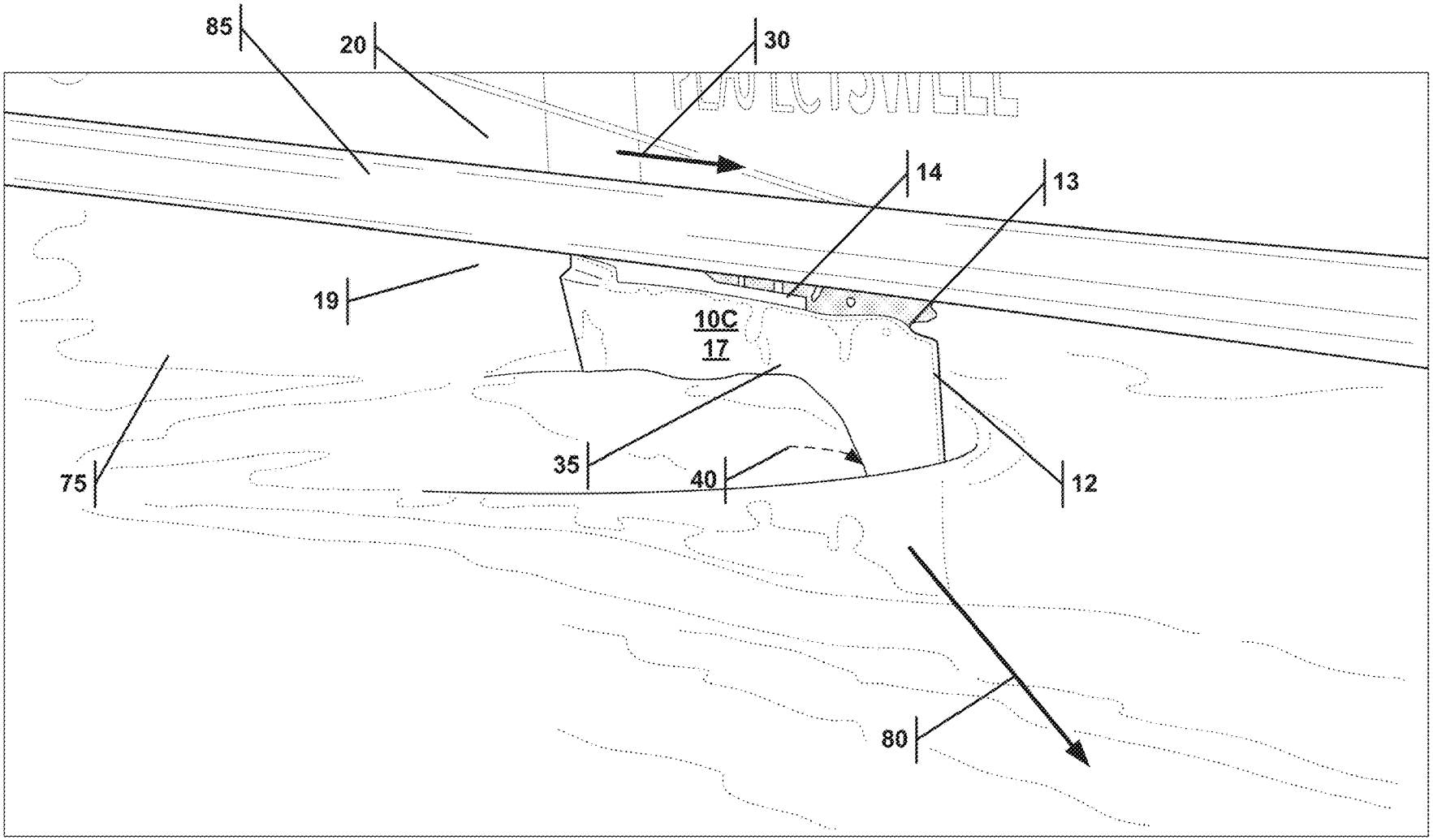
FIG. 4B is a second photo-illustrated view of a water foil being pulled through a wave pool by a conveyance.
Figure 4C:
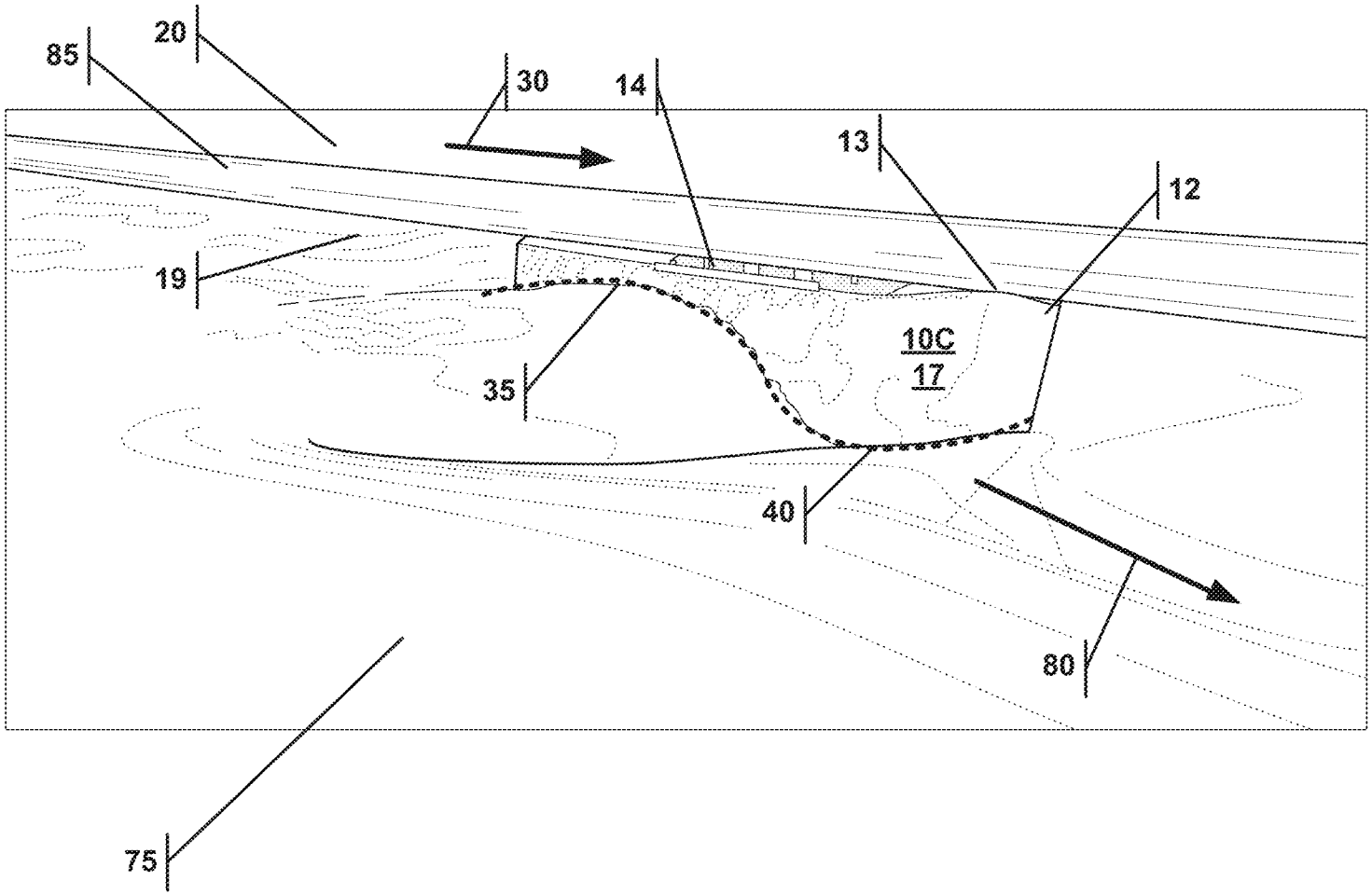
FIG. 4C is a third photo-illustrated view of a water foil being pulled through a wave pool by a conveyance.

FIGS. 4A-4C are photo-illustrated views of a water foil 10C and its inner surface 17 constructed consistently with the present invention and being pulled through a wave pool 75 by a conveyance 85 in the travel direction 30. The leading edge 12 cuts through the water, the second section 13 (i.e., the run-away from the shore side 19) creates a trough 40, and the third section 14 amplifies the peak 35, creating a wave that propagates in the direction 80.

The wave is initially created at the foil and, so the propagation of the wave is in the path of the foil. The wave, however, is a three-dimensional feature, and gravity induces it to spread outwardly from the foil (much like a wave created by dropping a pebble in a placid pond). Therefore, after a time, the wave swell appears to be at an angle to the foil path only because the initial wave profile has traveled towards shore under the influence of gravity. This angle is related to the foil speed along the path and to gravity as the wave travels outwardly from the foil.

Figure 5:
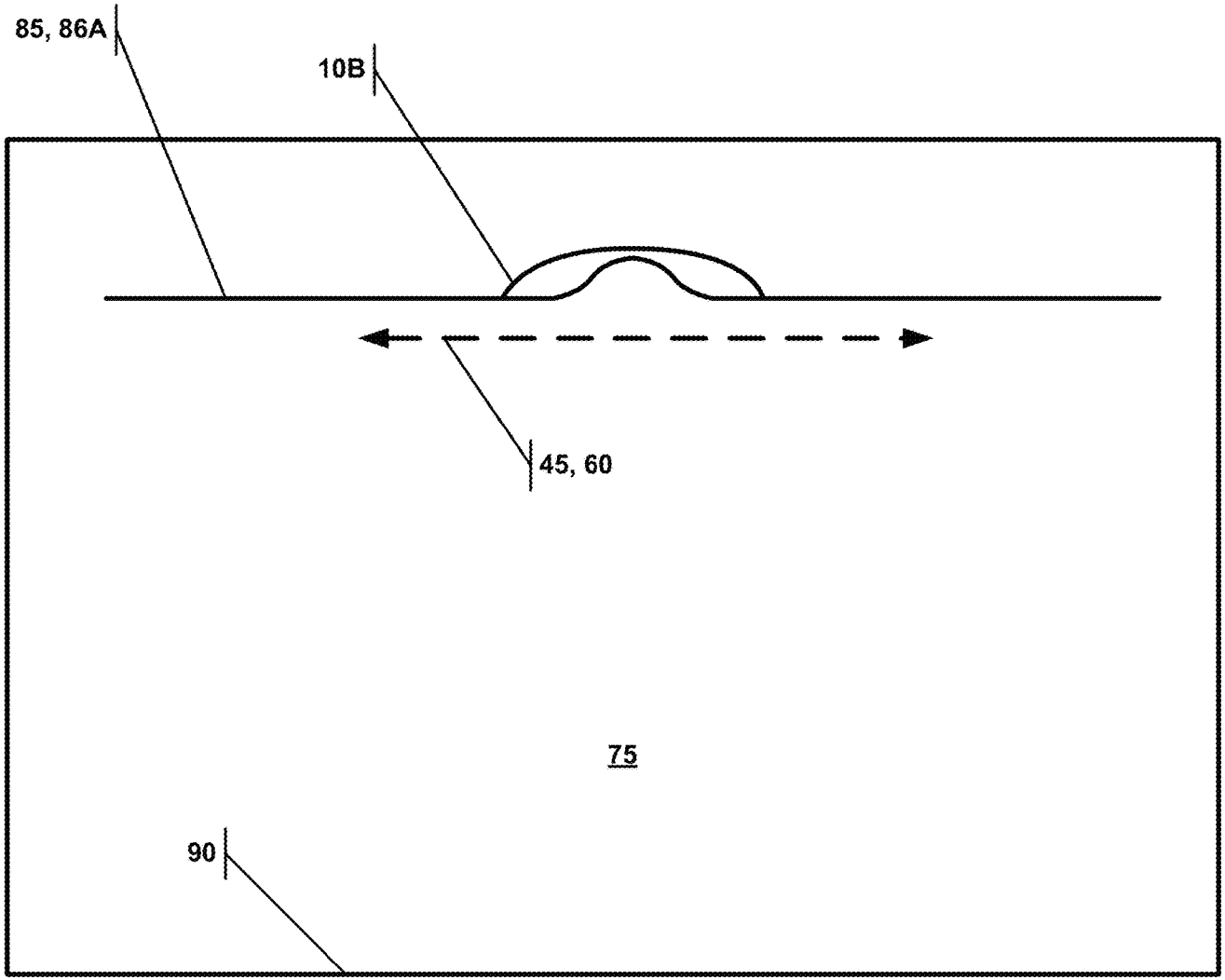
FIG. 5 is a top view of a wave pool with a water foil.
Figure 6A:
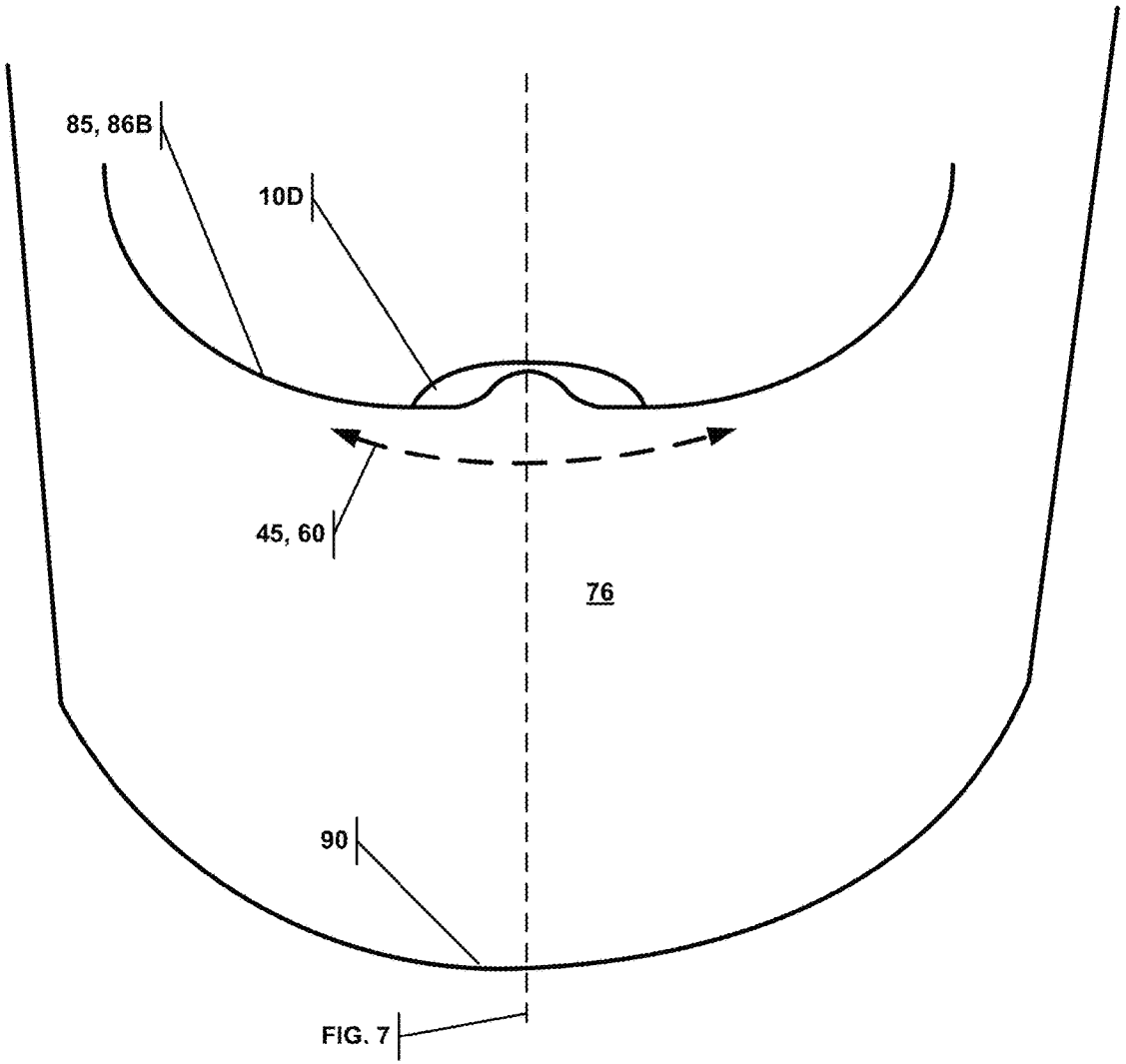
FIG. 6A is a top view of a wave pool with a water foil where the shore is curved, and the conveyance pulls the water foil in a curved path.
Figure 6B:
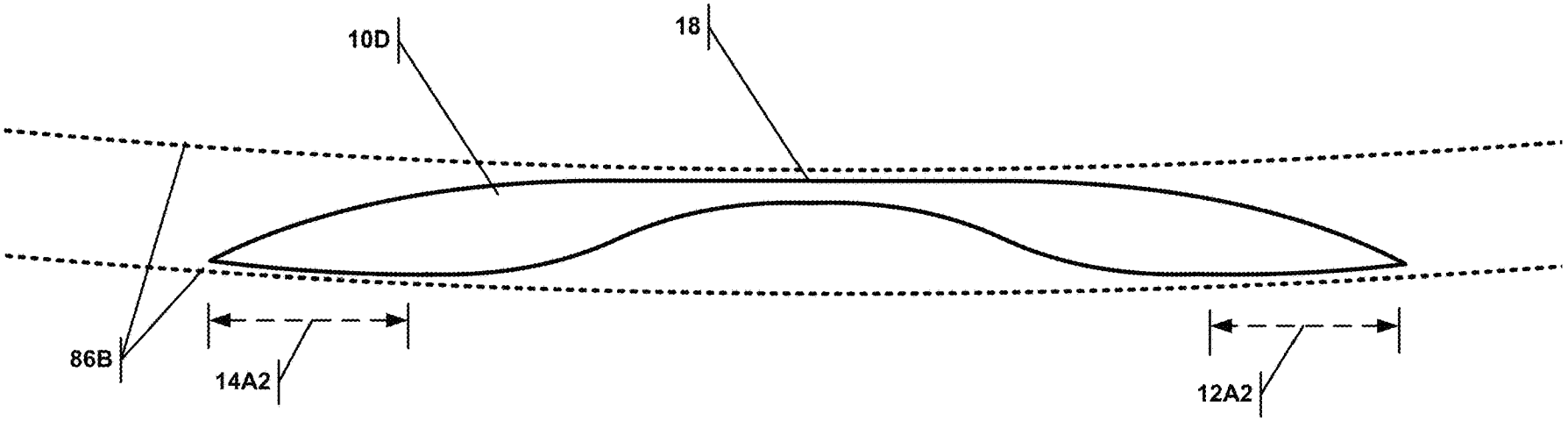
FIG. 6B is a top view of the curved foil used with a conveyance along a curved path.

FIG. 5 is a top view of a wave pool 75 with a shore 90 and a straight conveyance path 86A that propels a foil 10B in directions 45 and 60. The waves created travel towards the shore 90. FIG. 6A is a top view of a wave pool 76 with a shore 90 and a conveyance 85 with a curved path 86B propelling a curved foil 10D in directions 45 and 60. The waves created travel towards the shore 90. FIG. 6B is an enlarged view of the curved foil 10D. The conveyance 85 has a curved path 86. The first section 12A2 is curved to run parallel to the curved path 86B and minimizes bow wake and turbulence. Likewise, the fourth section 14A2 is curved to run parallel to the curved path 86B. The foil opposite side 18 may also be curved to minimize bow wake and turbulence.

Figure 7:
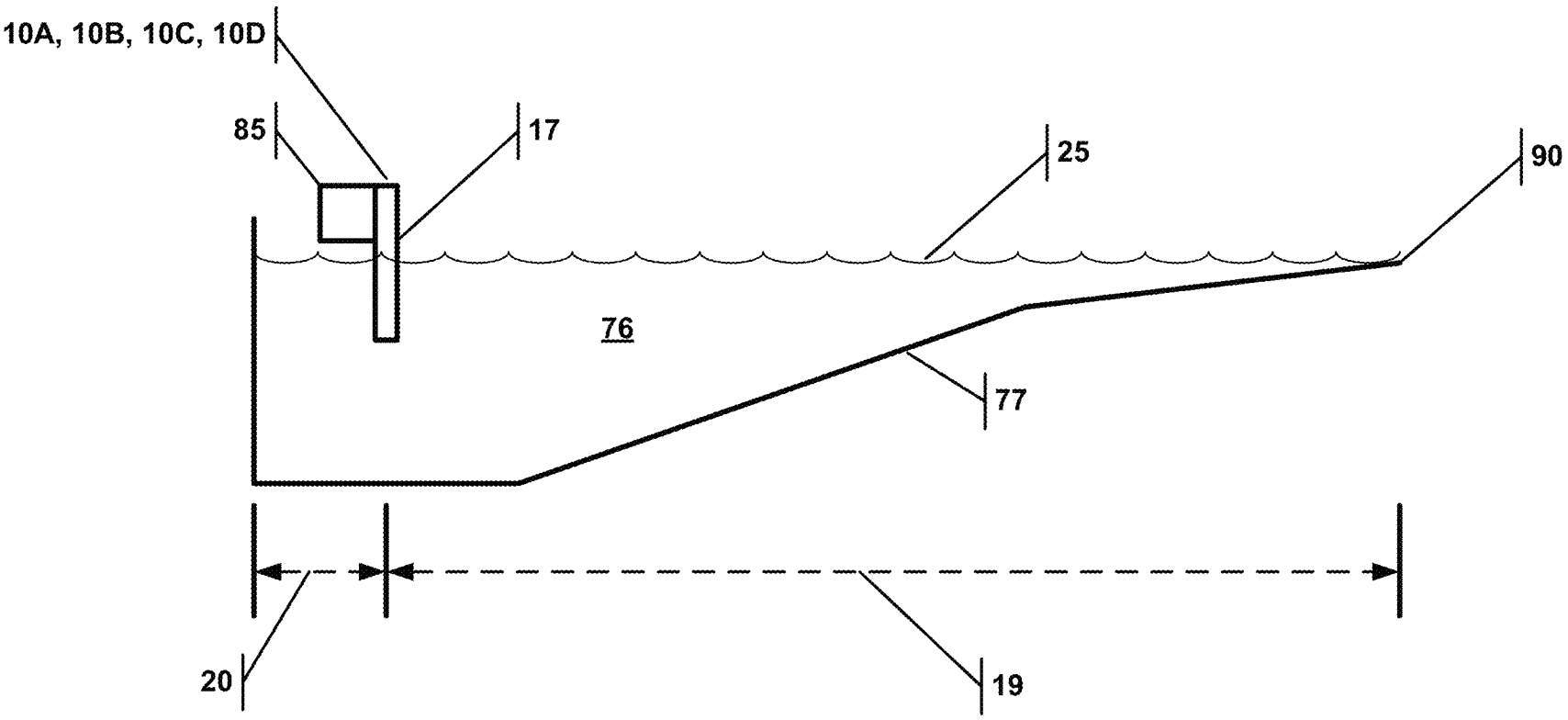
FIG. 7 is a cross-sectional view of the wave pool.

FIG. 7 is a cross-sectional view of the wave pool 76. This shows more clearly the shore side 19 and the opposite side 20, as defined by the travel line (here the conveyance 85 travels along the travel line). The foil (10A, 10B, 10C, 10D) has an inner surface 17 that extends below and above the water line 25 and faces the shore 90. The wave pool 76 may have a sloped floor 77, and preferably may have a sloped floor 77 with at least two different slopes. This amplifies the waves as they reach the shore 90.

Although exemplary embodiments and applications of the invention have been described herein including as described above and shown in the included example Figures, there is no intention that the invention be limited to these exemplary embodiments and applications or to the manner in which the exemplary embodiments and applications operate or are described herein. Indeed, many variations and modifications to the exemplary embodiments are possible as would be apparent to a person of ordinary skill in the art. The invention may include any device, structure, method, or functionality, as long as the resulting device, system or method falls within the scope of one of the claims that are allowed by the patent office based on this or any related patent application.

The invention claimed is:

1. A wave generating foil (10A, 10B, 10C) for use in a wave pool (75, 76) with a shore (90) and water line (25), the foil (10A, 10B, 10C) comprising:

an inner surface (17) extending from a leading edge (12) to a trailing edge (16), wherein the inner surface (17) extends below and above the water line (25) and faces the shore (90);

the inner surface (17) constructed to be propelled along a travel line (11), the travel line (11) defines a shore side (19) and an opposite side (20);

the inner surface (17) comprising:

a first section (12A, 12A2) that extends away from the leading edge (12) and parallel to the travel line (11);

a second section (13) that extends away from the first section (12A) towards the opposite side (20);

wherein the inner surface (17) further comprises a third section (14) that extends away from the second section (13) towards the shore side (19);

wherein the inner surface (17) further comprises a fourth section (14A, 14A2) that extends away from the third section (14) and parallel to the travel line (11).

2. The wave generating foil of claim 1, further comprising a plane of symmetry (15) extending perpendicularly from the travel line (11) and intersecting the inner surface (17) at a junction of the second (13) and third (14) sections.

3. The wave generating foil of claim 2, wherein the foil is further constructed to be propelled in either direction along the travel line (11).

4. The wave generating foil of claim 1, wherein the travel line is straight or curved.

5. A wave generating system comprising:

a wave pool (75, 76) with a shore (90) and water line (25);

a conveyance (85) crossing the wave pool (75, 76);

a wave generating foil (10A, 10B, 10C) constructed to be propelled along a travel line (11) by the conveyance (85), the travel line (11) defines a shore side (19) and an opposite side (20);

the foil (10A, 10B, 10C) comprising:

an inner surface (17) extending from a leading edge (12) to a trailing edge (16), wherein the inner surface (17) extends below and above the water line (25) and faces the shore (90);

the inner surface (17) comprising:

a first section (12A, 12A2) that extends from the leading edge (12) and parallel to the travel line (11);

a second section (13) that extends away from the first section (12A) towards the opposite side (20);

wherein the inner surface (17) further comprises a third section (14) that extends away from the second section (13) towards the shore side (19);

wherein the inner surface (17) further comprises a fourth section (14A, 14A2) that extends away from the third section (14) and parallel to the travel line (11).

6. The wave generating system of claim 5, further comprising a plane of symmetry (15) extending perpendicularly from the travel line (11) and intersecting the inner surface (17) at a junction of the second (13) and third (14) sections.

7. The wave generating system of claim 6, wherein the foil is further constructed to be propelled in either direction along the travel line (11) by the conveyance (85).

8. The wave generating system of claim 5, wherein the conveyance (85) travels in a straight path (86A).

9. The wave generating system of claim 5, wherein the conveyance (85) travels in a curved path (86B).

10. The wave generating system of claim 9, wherein the first section (12A2) is curved.

11. The wave generating system of claim 5, wherein:

the conveyance (85) travels in a curved path (86B);

the first section (12A2) is curved; and the fourth section (14A2) is curved.

12. The wave generating system of claim 5, wherein the shore (90) is curved.

13. The wave generating system of claim 5, wherein the wave pool (75, 76) comprises a sloped floor (77).

14. The wave generating system of claim 13, wherein the slope floor (77) has at least two different slopes.

15. The wave generating foil of claim 1, wherein the second section (13) is longer than the first section (12A, 12A2).

16. The wave generating system of claim 5, wherein the second section (13) is longer than the first section (12A, 12A2).

* * * * *